US005746488A

United States Patent [19]

LaCour

[11] Patent Number: 5,746,488

[45] Date of Patent: May 5, 1998

[54] STRESSED MODULAR DESK SYSTEM

[75] Inventor: Paul M. LaCour, Upper Saddle River, N.J.

[73] Assignee: LaCour,Inc., Harrington Park, N.J.

[21] Appl. No.: 542,170

[22] Filed: Oct. 12, 1995

Related U.S. Application Data

[63] Continuation-in-part of Ser. No. 189,459, Feb. 1, 1994, abandoned.

[51] Int. Cl.[6] ..... A47B 27/00

[52] U.S. Cl. ..... 312/196; 312/223.3

[58] Field of Search ..... 312/194, 196, 312/198, 257.1, 265.2, 265.4

[56] References Cited

U.S. PATENT DOCUMENTS

| | | |
|---|---|---|
| D. 161,772 | 1/1951 | MacDonald . |
| D. 249,609 | 9/1978 | Kramer . |
| D. 251,592 | 4/1979 | Giancario . |
| D. 251,666 | 4/1979 | Coon . |
| D. 252,635 | 8/1979 | Richgels . |
| D. 262,763 | 1/1982 | Lerner et al. . |
| D. 275,284 | 8/1984 | Wells et al. . |
| D. 298,889 | 12/1988 | LaCour . |
| D. 298,890 | 12/1988 | LaCour . |
| D. 305,706 | 1/1990 | Mark . |
| D. 331,672 | 12/1992 | Brodbeck . |
| 1,886,766 | 11/1932 | Ulrich . |
| 2,694,614 | 11/1954 | Dent . |
| 3,197,822 | 8/1965 | Herrschaft . |
| 3,525,560 | 8/1970 | Gasner et al. . |
| 3,564,138 | 2/1971 | Harrold . |
| 3,786,765 | 1/1974 | Burr . |
| 3,870,389 | 3/1975 | Killam . |
| 3,964,401 | 6/1976 | Gutmann, Jr. et al. . |
| 4,017,134 | 4/1977 | Lenglin et al. . |
| 4,050,752 | 9/1977 | Dykstra . |
| 4,145,098 | 3/1979 | Alexander . |
| 4,313,112 | 1/1982 | Foster . |
| 4,316,082 | 2/1982 | Fritz . |
| 4,345,803 | 8/1982 | Heck . |
| 4,418,967 | 12/1983 | Winkelman, Jr. et al. . |
| 4,449,762 | 5/1984 | Turner . |
| 4,458,961 | 7/1984 | Browning . |
| 4,577,928 | 3/1986 | Brown . |
| 4,600,248 | 7/1986 | Pfieger . |
| 4,619,486 | 10/1986 | Hannah et al. . |
| 4,620,684 | 11/1986 | Delpercio et al. . |
| 4,633,324 | 12/1986 | Giulie . |
| 4,660,905 | 4/1987 | Conner et al. . |
| 4,671,481 | 6/1987 | Beard . |
| 4,755,009 | 7/1988 | Price et al. . |
| 4,766,422 | 8/1988 | Wolters et al. . |
| 4,768,845 | 9/1988 | Yeh . |
| 4,798,423 | 1/1989 | LaCour . |
| 4,836,625 | 6/1989 | Catta . |
| 4,846,078 | 7/1989 | Janson . |
| 4,863,242 | 9/1989 | Correa . |
| 4,883,330 | 11/1989 | Armstrong et al. . |
| 4,920,458 | 4/1990 | Jones . |
| 4,961,295 | 10/1990 | Kosch, Sr. et al. ..... 211/94.02 |

(List continued on next page.)

FOREIGN PATENT DOCUMENTS

| | | |
|---|---|---|
| 0145410 | 6/1985 | European Pat. Off. . |
| 2183453 | 6/1987 | United Kingdom . |

OTHER PUBLICATIONS

Interior Design, "Trading Desks", pp. 1–3, Feb. 1990.

*Primary Examiner*—Peter R. Brown
*Assistant Examiner*—Gerald A. Anderson
*Attorney, Agent, or Firm*—Selitto & Associates, P.C.

[57] ABSTRACT

A stressed modular desk system employs a core having an interior raceway and a substantially open top, whereby the raceway is accessible from above. Electronic equipment, such as computer monitors, can be mounted on a plurality of platforms, each platform being supported from a support structure which extends between opposite ends of the raceway core and which spans the raceway without significantly obstructing the open top of the raceway core. At least one of the platforms is supported in cantilevered fashion by the support structure.

45 Claims, 7 Drawing Sheets

U.S. PATENT DOCUMENTS 4,997,240 3/1991 Schmalzi et al. .
5,024,167 6/1991 Hayward .
5,035,470 7/1991 Miller .
5,046,791 9/1991 Kooiman .
5,071,204 12/1991 Price .
5,094,174 3/1992 Grund et al. .
5,101,298 3/1992 Lentz et al. .
5,103,741 4/1992 Grund et al. .
5,130,494 7/1992 Simonton et al. .
5,174,223 12/1992 Nagy et al. .
5,183,319 2/1993 Pearson et al. .
5,220,871 6/1993 Grund et al. .
5,224,429 7/1993 Borgman et al. .
5,408,939 4/1995 Lechman .
5,423,604 6/1995 Chern .
5,513,759 5/1996 Besserer et al. .
5,609,402 3/1997 Kemp .

STRESSED MODULAR DESK SYSTEM

CROSS REFERENCE TO RELATED APPLICATION

This is a continuation-in-part of application Ser. No. 08/189,459 filed Feb. 1, 1994 now abandoned.

FIELD OF THE INVENTION

The present invention relates to a desk system, and, more particularly, to a desk system which is especially adapted to house data and communication equipment, such as telephones and computer terminals.

BACKGROUND OF THE INVENTION

With the advent of microprocessor-based data distribution systems, the use of electronic voice and computerized information systems has proliferated, especially in the business sector. For instance, in the money commodity dealing field, it is common to provide trading rooms with a plurality of work stations, each station typically including a variety of data and communication equipment such as computer keyboard or keyboards, computer display screens in the form of cathode ray tubes, a telephone turret with a specified number of direct lines and telephone line monitoring units and other peripheral devices. In order to ensure optimum interaction between traders during trading periods to make maximum unitization of space, the work stations are oftentimes ganged together to form a cluster of work stations. Such clusters can be formed by arranging several double work stations (i.e., two work stations arranged in back-to-back or tandem fashion) side-by-side, the resulting cluster comprising two rows of back-to-back work stations.

In providing work stations in trading rooms, there are special considerations that need to be addressed. One consideration relates to the provision of clear sight lines over the work stations for various purposes including efficient communication between traders in the trading room. Another consideration relates to the provision of work stations adapted for quick and efficient assembly, disassembly and reconfiguration due to the advent of the 24 hour global trading practices and the consequences resulting therefrom (e.g., the need to complete services, removal, upgrade and/or reconfiguration of work stations within the limited time period of off hours, such as evening, weekends and holidays). In addition, because of the proliferation of the local area network and desk top computer technology, there are numerous user-preferred combinations of computer-related equipment varying from work station to work station. As a result, the work stations need to be adapted for adjustability and retrofittability in accordance with user preference.

Computer work stations have been developed in the past (see, for instance, U.S. Pat. Nos. Des. 251,666; U.S. Pat. No. Des. 275,284; U.S. Pat. Nos. 4,316,082; 4,345,803 and 4,449,762). While some of these work stations have a modular construction (see, for instance, U.S. Pat. Nos. 4,313,112 and 4,458,961) and others are adapted to be ganged together (see, for instance, U.S. Pat. No. Des. 251,592), they are not specifically designed to be arranged in back-to-back or side-by-side fashion due to their absence of a common, unobstructed raceway core and/or double faced center spline slat wall partition. Thus, these work stations are not especially suitable for the formation of clusters which comprise two rows of work stations arranged back-to-back. As a result, such clusters have in the past been formed by arranging conventional desks in back-to-back fashion (see, for instance, U.S. Pat. Nos. 1,886,766 and 2,694,614).

One problem encountered when gaging together the conventional desks or computer work stations described above involves providing adequate room for and access to the necessary telephone, data and electrical service lines and accessory equipment. Without adequate room for technicians to gain access to such service lines and accessory equipment, field installation and maintenance can be made difficult.

U.S. Pat. Nos. 4,619,486 and 4,883,330 disclose a spine assembly adapted to support a pair of desk tops in back-to-back fashion. A plurality of spine assemblies may be joined end-to-end to create an interconnected network of desk assemblies. While each spine assembly is adapted to house utility and communication lines, no provision is made to mount electronic equipment, such as computer control processing units and monitors, from or in the spine assembly.

Frame-type desk systems have also been developed. Such a desk system includes a frame assembly to support its utilitarian components. More particularly, the frame assembly, which is typically constructed of steel tubes or aluminum extrusions, is provided with a rear perimeter frame for supporting a slat wall extrusion, which has a plurality of continuous grooves extending horizontally between ends thereof for supporting a plurality of monitors in cantilevered fashion, and a front perimeter frame for supporting a raceway fascia. The front and rear frames are connected to each other via a pair of upper transverse extrusions and a pair of lower transverse extrusions, which extend along the floor supporting the desk system. For supporting a work top, an angular tube frame extends outwardly from the top of the front frame over a knee well adapted to receive the user's legs.

Because of its frame construction, the desk system suffers from several problems. For instance, because it is typically required that the frame assembly be pre-assembled prior to its shipping to an installation site in order to reduce the overall installation time, problems concerning the shipping and handling of the pre-assembled frame assembly are created due to the large size of the pre-assembled frame assembly. Further, because each desk system is supported by its own frame assembly, there are structures which become redundant when a plurality of frame-type desk systems are used in a back-to-back work station configuration and which thereby take up valuable space.

U.S. Pat. No. 4,798,423 to Paul M. LaCour, the inventor herein, discloses a modular desk system comprising two work tops arranged to provide a pair of back-to-back work stations. The desk system is specifically designed so that it can be ganged in end-to-end fashion with other similar desk systems to form a cluster of work stations. The work tops of each desk system are cantilevered from a core, which is common to both of the work stations and which has a substantially unobstructed, interior raceway for data, communication and electrical service lines and accessory equipment. The top of the core is substantially open (i.e., uncovered) so that a monitor and telephone equipment turrets can be lowered below the work top elevation and into the core without obstructing ancillary support structure. While the core has the capability of housing telephone and computer equipment contained within the turret, such equipment has a predetermined, substantially fixed position within the turret, thereby inhibiting their repositioning and/or adjustment in the field in response to changing needs and requirements of the user.

The desk system disclosed in the LaCour '423 Patent has been a commercial success since its introduction to the marketplace. While it continues to have utility in installations where user needs and requirements are unlikely to change significantly during the lifetime of the desk system, there is now a need for a desk system possessing the benefits and advantages of the one disclosed in the LaCour '423 Patent, as well as the potential for greater field adjustability and retrofittability (i.e., greater "flexibility").

SUMMARY OF THE INVENTION

The present invention overcomes the disadvantages and shortcomings of the prior art discussed above by providing a new and improved desk system having greater "flexibility", in general, and, in particular, the ability to accommodate changing work environments, particular ergonomic preferences of the user and changes in equipment size, shape and configuration. More specifically, the present invention relates to a stressed modular desk system which includes a core having an interior raceway extending longitudinally from end of the core to an opposite end of the core. The core also has a substantially open top, whereby the raceway is accessible from above. The desk system is equipped with a mounting mechanism, including a plurality of platforms, adapted to mount electronic equipment therefrom. The platforms are supported from a support structure which extends between the opposed ends of the core and which spans the raceway without significantly obstructing the open top of the core. The support structure supports each of the platforms such that it extends outwardly therefrom above the raceway. At least one of the platforms is supported in a cantilevered fashion by the support structure.

By mounting the platforms from the support structure such that they can be moved both vertically and horizontally, their positions can be selectively varied to suit the aforementioned variables; namely, changing work environments, particular ergonomic preferences of the user and changes in equipment size, shape and configuration. Because the platforms are removable, they can also be replaced by other interchangeable platforms or by completely different components.

In addition to permitting electronic equipment to be mounted above the raceway, the desk system, due to the substantially unobstructed nature of the raceway, also permits electronic equipment to be carried by a trolley system housed within the raceway. The trolleys of such a system can be readily moved and/or removed, thereby increasing the "flexibility" of the desk system.

The desk system of the present invention lends itself to single work station embodiments, as well as to double work station embodiments. Moreover, both the single work station embodiments and the double work station embodiments can be ganged in end-to-end fashion with other similar desk systems to form a customized cluster of work stations.

BRIEF DESCRIPTION OF THE DRAWINGS

For a more complete understanding of the present invention, reference is made to the following detailed description of four exemplary embodiments considered in conjunction with the accompanying drawings, in which.

DESCRIPTION OF THE EXEMPLARY EMBODIMENTS

Although the present invention is applicable to many different types of data and communication desk systems, it is especially suitable for use in connection with money market and commodity dealing desk systems.

Accordingly, the present invention will be described in connection with four exemplary embodiments of such a dealing desk system. It should be understood, however, that the following description is only meant to be illustrative of the present invention and is not meant to limit the scope of the present invention, which has applicability to other types of desk systems.

The First Embodiment

The Raceway Core Subassembly

Figure 1:
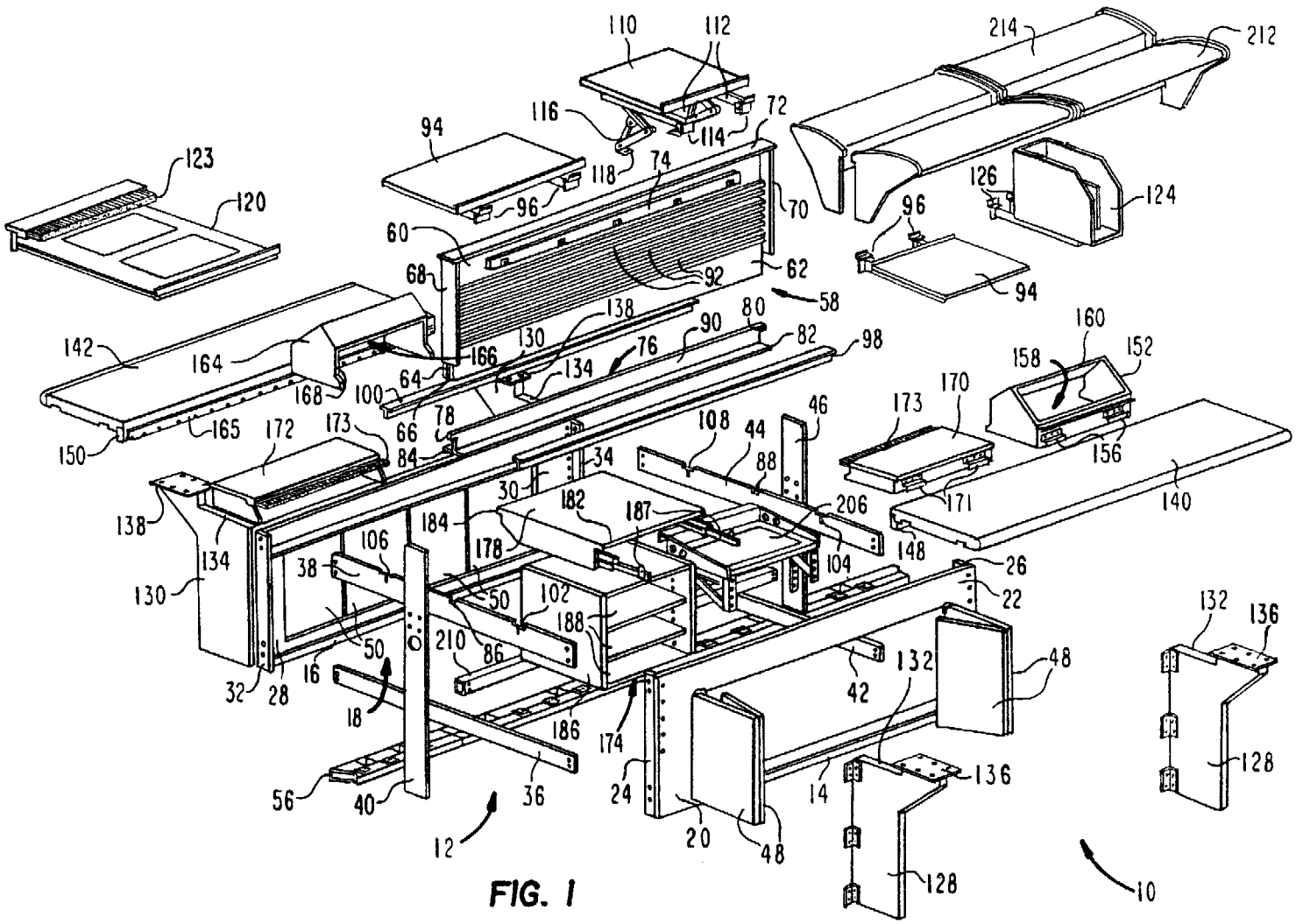
FIG. 1 is an exploded perspective view of a flexible dealing desk system constructed in accordance with a first embodiment of the present invention.
Figure 2B:
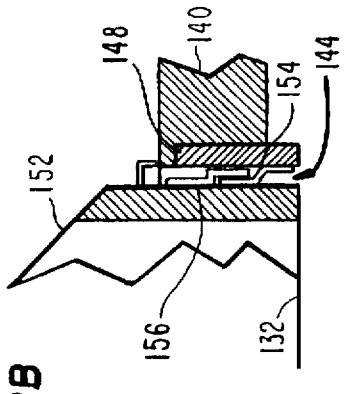
FIG. 2B is an enlarged cross-sectional view of a portion of the dealing desk system shown in FIG. 2A.
Figure 2C:
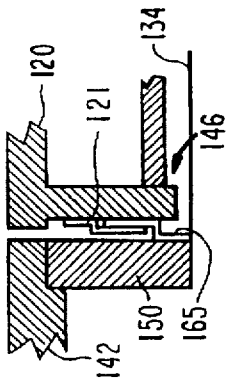
FIG. 2C is an enlarged cross-sectional view of another portion of the dealing desk system shown in FIG. 2A.
Figure 2A:
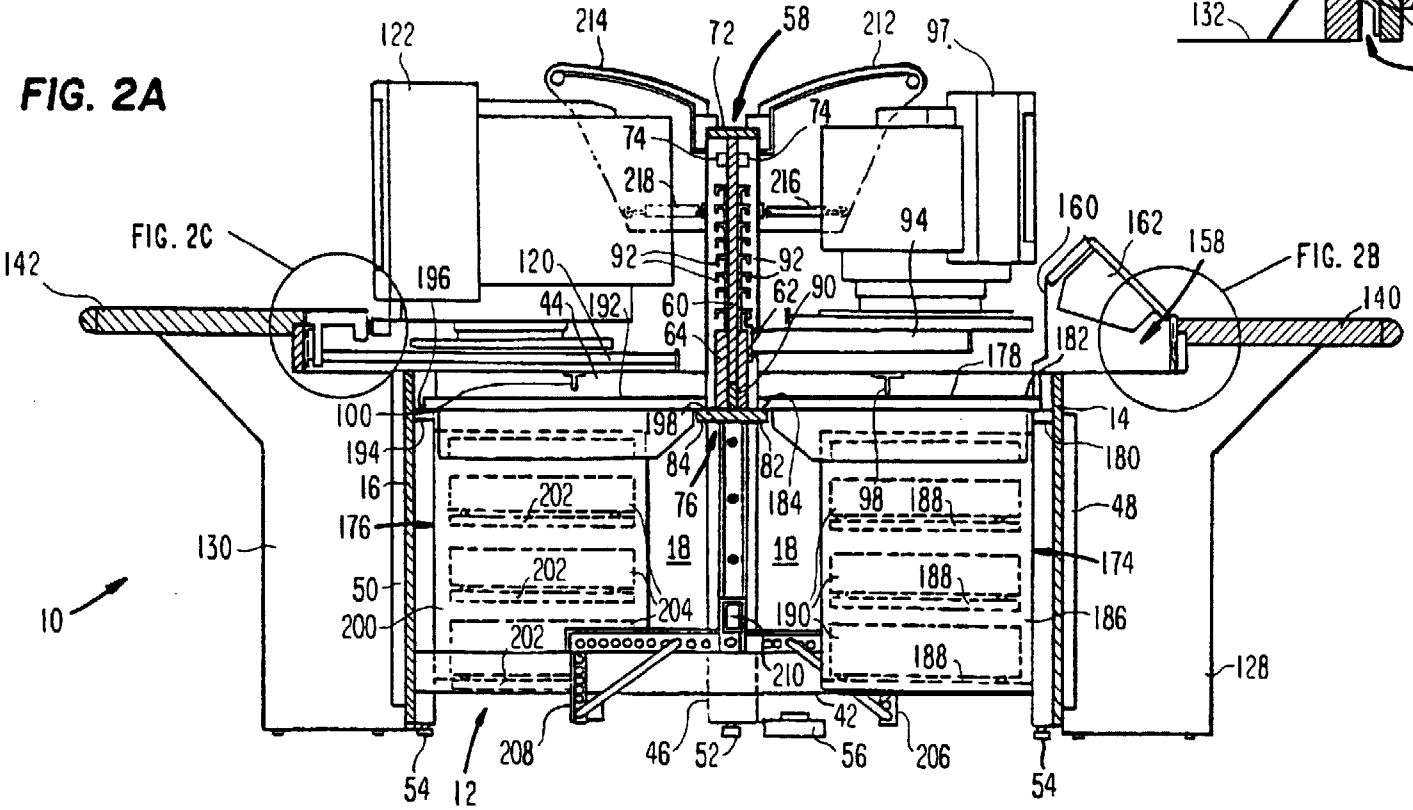
FIG. 2A is a transverse cross-sectional view of the dealing desk system shown in FIG. 1.

Referring to FIGS. 1 and 2A, a dealing desk system 10, which has a double work station construction, includes a freestanding raceway core 12 made from raceway fasciae 14, 16 which cooperate to define a substantially unobstructed raceway 18 therebetween. The raceway 18 is large enough to create a crawlspace and to otherwise accommodate telephone, data and electrical service lines and accessory equipment to be described in more detail hereinafter. Moreover, the size of the raceway 18 and its unobstructed nature facilitate accessibility by technicians responsible for servicing the equipment housed in the raceway 18. Because the raceway core 12 is also designed for easy assembly and disassembly, initial installation and periodic servicing by technicians are further facilitated as described in greater detail hereinafter.

Lateral ends 20, 22 of the raceway fascia 14 are connected to outer posts 24, 26, respectively, which constitute integral parts of the raceway fascia 14. Similarly, lateral ends 28, 30 of the raceway fascia 16 are connected to outer posts 32, 34, respectively, which constitute integral parts of the raceway fascia 16. The outer posts 24, 32 are attached to a lower strut 36 and to an upper strut 38, both of which are also attached to a vertical support post 40. Similarly, the outer posts 26, 34 are attached to a lower strut 42 and to an upper strut 44, both of which are also attached to a vertical support post 46.

The raceway fasciae 14, 16 are provided with movable access doors 48, 50, respectively, which are adapted to ventilate the raceway 18 and to control access thereto. The access doors 48, 50 can be removable, as well as movable. For example, the access doors 48, 50 can slide from side-to-side or can pivot upwardly or to the side.

The raceway core 12 also includes inner levelers 52 and outer levelers 54 (see FIG. 2A). The inner levelers 52 cooperate with the outer levelers 54 to permit leveling of the desk system 10.

A strip of electrical outlets 56 is provided along the bottom of the raceway core 12 so that electricity can be readily provided to electrical devices mounted in the raceway 18, as well as to electronic equipment located above the raceway 18. The use and location of the strip of electrical outlets 56 are options which can be varied from installation to installation depending upon user preferences and needs. Because the lower struts 36, 42 are suspension-mounted (i.e., mounted above the floor supporting the desk system 10) and therefore accommodate floor mounted electrical power strips, such as the strip of electrical outlets 56, all such floor-mounted electrical power strips can be installed prior to the assembly of the desk system 10, making such installation easier to perform. As a further option, the raceway fasciae 14, 16 may be equipped with strips of electrical outlets (not shown) so that electricity can be readily supplied to external electrical devices such as calculators and lap top computers.

The Slat Wall Partition Subassembly

Referring still to FIGS. 1 and 2A, the desk system 10 is also provided with a slat wall partition subassembly 58 having a substantially planar construction. More particularly, the slat wall partition subassembly 58 includes a slat wall partition 60 and panels 62, 64 depending from opposite sides of the slat wall partition 60. The panels 62, 64 extend below the slat wall partition 60 so as to form a groove 66 whose function will be described hereinafter. The slat wall partition subassembly 58 also includes end caps 68, 70, which are attached to opposite ends of the slat wall partition 60, and an upper cap 72, which extends above the slat wall partition 60. Strips 74 of electrical outlets are provided on the slat wall partition 60 so that electricity can be readily supplied to electronic equipment mounted from the slat wall partition 60 in a manner to be described hereinafter.

With particular reference to FIG. 1, the desk system 10 includes an inverted T spline 76 which has tabs 78, 80 at lateral ends thereof and rails 82, 84 extending toward the raceway fasciae 14, 16, respectively, for purposes to be discussed hereinafter. The inverted T spline 76 extends between the vertical support posts 40, 46 with the tabs 78, 80 nesting in slots 86, 88, respectively, provided in the upper struts 38, 44, respectively. Referring to both FIGS. 1 and 2, the slat wall partition subassembly 58 is mounted between the vertical support posts 40, 46 by resting it on the inverted T spline 76 such that a tongue-like portion 90 of the inverted T spline 76 is received in the groove 66 of the slat wall partition subassembly 58. As an option, the strip of electrical outlets 56 or another similar outlet strip (not shown) may be mounted on the bottom of the inverted T spline 76.

The slat wall partition 60 includes a plurality of L-shaped slats 92 on both sides thereof for removably cantilevering platforms 94 from opposite sides of the slat wall partition 60. The platforms 94 have Z-shaped flanges 96 which can be interconnected with and disconnected from the slats 92 such that the height of the platforms 94 can be adjusted (i.e., raised or lowered) by the installer or by the user. The platforms 94, which are also movable along the length of the slats 92 (i.e., toward and away from the end caps 68, 70), can be used to support computer monitors 97 (see FIG. 2A) and/or any other components of the desk system 10, such as a shelf unit (not shown).

As shown in FIGS. 1 and 2A, the desk system 10 also includes T bars 98, 100. Opposed ends of the T bar 98 are removably inserted into complementarily shaped slots 102, 104 provided in the upper struts 38, 44, respectively, of the raceway core 12. While the slot 102 is located between the vertical support post 40 and the outer post 24, the slot 104 is located between the vertical support post 46 and the outer post 26. Similarly, opposed ends of the T bar 100 are removably inserted into complementarily shaped slots 106, 108 provided in the upper struts 38, 44, respectively, of the raceway core 12. While the slot 106 is positioned between the vertical support post 40 and the outer post 32, the slot 108 is located between the vertical support post 46 and the outer post 34.

The desk system 10 also includes tiltable platforms 110 (only one of which is shown in FIG. 1) equipped with horizontal support members 112 having Z-shaped flanges 114 which can be interconnected with and disconnected from the slats 92 of the slat wall partition 60 such that the height of the platforms 110 can be adjusted (i.e., raised or lowered) by the installer or by the user. The flanges 114 are pivotally connected to the support members 112 so that the orientation of the platforms 110 relative to the horizontal can be varied to accommodate the ergonomic preferences of the user. The platforms 110 also include vertical support members 116 which depend therefrom and which have feet 118 adapted to engage one of the T bars 98, 100. The support members 116 articulate to adjust the angular orientation of the platforms 110. When the angular orientation of the platforms 110 has been established, the support members 116 also function to provide additional support for the platforms 110. Like the platforms 94, the platforms 110 may be moved along the length of the slats 92 and can support computer monitors and/or any other components of the desk system 10, such as a shelf unit (not shown).

The desk system 10 also includes stands 120 (only one of which is shown in FIGS. 1 and 2A). The stand 120 shown in FIGS. 1 and 2A is equipped with a Z-shaped hook or clip 121 (see FIG. 2C) whose function will be described hereinafter. The stand 120, which is sized and shaped so as to support a large computer monitor 122, rests on the T bar 100 and on the raceway fascia 16 (see FIG. 2A). Because the stands 120 are supported by the T bars 98, 100 and the raceway fasciae 14, 16, they provide the lowest mounting position for viewable equipment, such as computer monitors and the like. Thus, the stands 120 can be advantageously used in lieu of the platforms 94 and/or the platforms 110 when there is a need to support large equipment, such as the computer monitor 122, which would otherwise impair user visibility if supported by the platforms 94 or by the platforms 110. The stands 120 include a continuous brush grommet 123 which allows the passage of electrical supply lines and the like.

The desk system 10 also includes storage bins 124 (only one of which is shown in FIG. 1). The storage bins 124 have Z-shaped flanges 126 which can be interconnected with and disconnected from the slats 92 of the slat wall partition 60 such that the height of the storage bins 124 can be adjusted (i.e., raised or lowered) by the installer or by the user. The storage bins 124, which are also movable along the length of the slats 92, can be used to store files and the like.

It should be noted that the slat wall partition 60 may be replaced by any other conventional means for supporting the platforms 94 and the storage bins 124 in a cantilevered fashion. Regardless of the cantilevering means employed, the platforms 94 and the storage bins 124 are suspended directly above the substantially open (i.e., uncovered) upper end of the raceway core 12.

The Work Top Subassemblies

Referring to FIGS. 1 and 2A–C, the desk system 10 includes one pair of support panels 128, extending outwardly from or alongside the lateral ends 20, 22 of the raceway fascia 14, and another pair of support panels 130, extending outwardly from or alongside the lateral ends 28, 30 of the raceway fascia 16. The support panels 128 have lower ledges 132 which are at the same elevation as an upper end of the raceway fascia 14, while the support panels 130 have lower ledges 134 which are at the same elevation as an upper end of the raceway fascia 16. The support panels 128, 130 also include upper ledges 136, 138, respectively, for purposes to be discussed hereinafter.

Work tops 140, 142 rest on the upper ledges 136 of the support panels 128 and on the upper ledges 138 of the support panels 130, respectively, to form a pair of back-to-back work stations. The work tops 140, 142 are spaced from the raceway fasciae 14, 16, respectively, to form equipment bays 144, 146, respectively, (see FIGS. 2B and 2C) extending between the support panels 128, 130, respectively, and outwardly from the raceway core 12. Support stringer cleats 148, 150 depend from the work tops 140, 142, respectively, and extend to the lower ledges 132, 134, respectively, of the support panels 128, 130, respectively.

As shown, in general, in FIGS. 1 and 2A and, in detail, in FIGS. 2B and 2C, the desk system 10 includes a telecommunication turret 152 which is inserted into the equipment bay 144 and is removably connected to the cleat 148 of the work top 140 by a continuous Z-shaped hook or clip 154, which extends along the cleat 148 of the work top 140, and by mating Z-shaped hooks or clips 156 which are attached to the turret 152. A rear portion of the turret 152 rests on the upper edge of the raceway fascia 14. The turret 152 has a bottomless chamber 158 which includes an access opening 160 adapted to permit data, communication and electrical service lines (not shown) to be run from the raceway 18 to a plurality of telephone tubs 162 (see FIG. 2A) housed in the chamber 158. Because the chamber 158 overhangs the equipment bay 144, its open bottom is accessible from the knee well area (i.e., the area below the work top 140) so that the electrical service lines can be run to the telephone tubs 162 from the knee well area.

Similarly, a telecommunication turret 164 is inserted into the equipment bay 146 and is removably connected to the cleat 150 of the work top 142 by a continuous Z-shaped hook or clip 165, which extends along the cleat 150 of the work top 142, and mating Z-shaped hooks or clips (not shown, but similar to the Z-shaped hook 121) attached to the turret 164. A rear portion of the turret 164 rests on the upper edge of the raceway fascia 16. The turret 164 has a bottomless chamber 166 which includes an access opening 168 adapted to permit data, communication and electrical service lines (not shown) to be run from the raceway 18 to a plurality of telephone tubs (not shown) housed in the chamber 166. Because the chamber 166 overhangs the equipment bay 146, its open bottom is accessible from the knee well area (i.e., the area below the work top 142) so that electrical service lines can be run to the telephone tubs (not shown) from the knee well area.

As shown in FIG. 1, the desk system 10 also includes a work top extension 170 which is removably connected to the work top 140 by Z-shaped hooks or clips 171 which mate with the Z-shaped hook 154 (see FIG. 2B) attached to the cleat 148 of the work top 140. The work top extension 170 sits in the equipment bay 144 with a rear portion thereof resting on the upper edge of the raceway fascia 14. Similarly, a work top extension 172 is removably connected to the work top 142 by Z-shaped hooks or clips (not shown) which mate with the Z-shaped hook 165 attached to the cleat 150 of the work top 142. The work top extension 172 sits in the equipment bay 146 with a rear portion thereof resting on the upper edge of the raceway fascia 16. The work top extensions 170, 172 cover any exposed portions of the equipment bays 144, 146, respectively. Continuous brush grommets 173 are provided on the work top extensions 170, 172 to allow the passage of electrical supply lines and the like.

The Trolley Subassemblies

Referring to FIGS. 1 and 2A, due to the size of the raceway 18 and its lack of significant obstructions, it can be used to house electronic equipment trolleys 174, 176, as well as the telecommunication, data and electrical service lines referred to above. The trolley 174 includes a glide plate 178 which bridges an open span between the rail 82 of the inverted T spline 76 and a rail 180 (see FIG. 2A) mounted on the raceway fascia 14 between the outer posts 24, 26. More particularly, one edge 182 of the guide plate 178 rides on the rail 180, while an opposite edge 184 of the guide plate 178 rides on the rail 82. The ability of the guide plate 178 to slide back and forth along the length of the rails 82, 180 can be improved by providing the rails 82, 180 and/or the edges 182, 184 of the guide plate 178 with a layer of anti-friction material (not shown). For instance, nylon glides may be provided on the rails 82, 180, while runners may be provided on the edges 182, 184 of the glide plate 178.

A cabinet 186 is suspended from the glide plate 178 of the trolley 174 by pull glides 187 such that the cabinet 186 can be moved between a retracted position, in which it is housed completely within the raceway core 12, and an extended position, in which it projects outwardly from the raceway core 12. The cabinet 186 houses a plurality of trays 188, each of which is sized and shaped so as to carry a central processing unit 190 (shown in phantom in FIG. 2A) of a computer. Alternatively, the trays 188 may carry any other type of electronic equipment. Each of the trays 188 can be moved between a retracted position, in which it is housed completely within the cabinet 186, and an extended position, in which it projects outwardly from the cabinet 186. Thus, when the access doors 48 are opened, either the entire cabinet 186 or the individual trays 188 can be extended far enough so as to project outwardly from the raceway core 12, thereby providing easy access to the central processing units 190 or any other electronic equipment carried by the trays 188.

The trolley 176 (see FIG. 2A) includes a glide plate 192 which bridges an open span between the rail 84 of the inverted T spline 76 and a rail 194 mounted on the raceway fascia 16 between the outer posts 32, 34. More particularly, one edge 196 of the guide plate 192 rides on the rail 194, while an opposite edge 198 of the glide plate 192 rides on the rail 84. The ability of the glide plate 192 to slide back and forth along the length of the rails 84, 194 can be improved by providing the rails 84, 194 and/or the edges 196, 198 of the glide plate 192 with a layer of anti-friction material (not shown). For instance, nylon glides may be provided on the rails 84, 194, while runners may be provided on the edges 196, 198 of the glide plate 192.

A cabinet 200 is suspended from the glide plate 192 of the trolley 176 by pull glides (not shown) such that the cabinet 200 can be moved between a retracted position, in which it is housed completely within the raceway core 12, and an extended position, in which it projects outwardly from the raceway core 12. The cabinet 200 houses a plurality of trays 202 (shown in phantom in FIG. 2A), each of which is sized and shaped so as to carry a central processing unit 204 (also shown in phantom in FIG. 2A) of a computer. Alternatively, the trays 202 may carry any other type of electronic equipment. Each of the trays 202 can be moved between a retracted position, in which it is housed completely within the cabinet 200, and an extended position, in which it projects outwardly from the cabinet 200. Thus, when the access doors 50 are opened, either the entire cabinet 200 or the individual trays 202 can be extended far enough so as to project outwardly from the raceway core 12, thereby providing easy access to the central processing units 204 or any other electronic equipment carried by the trays 202.

The raceway core 12 also houses modem shelves with EIA (i.e., Electronics Industry Association Standard) or similar standard rack mounts 206, 208, each of which is slidably mounted on a beam 210 extending between brackets (not shown) mounted on lower portions of the vertical support posts 40, 46, respectively. The beam 210 is adjustably attached to the brackets such that the height of the support beam 210 can be varied (i.e., raised or lowered) by the user or the installer. The fiber optic trolleys 206, 208 are adapted to guide and protect fiber optic wires (not shown) running through the raceway core 12. If fiber optic wires are not required, the fiber optic trolleys 206, 208 can be removed so that they do not interfere with the movement of the trolleys 174, 176. Because the beam 210 does not interfere with the movement of the trolleys 174, 176 and does not otherwise create a significant obstruction within the raceway 18, it could remain even if the fiber optic trolleys 206, 208 are removed. Of course, the beam 210 could be removed along with the fiber optic trolleys 206, 208.

The Monitor Cowling Subassemblies

Figure 3:
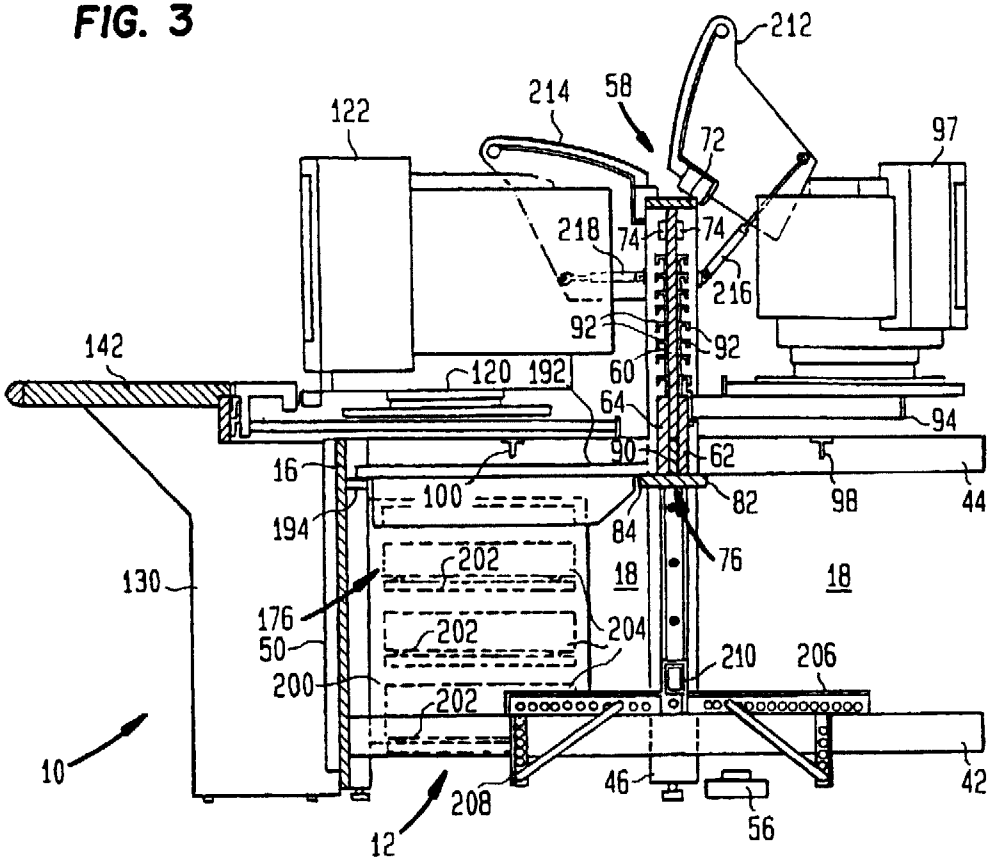
FIG. 3 is transverse cross-sectional view similar to that of FIG. 2A, except that one the work stations has been partially disassembled to make certain electronic equipment more accessible to technicians performing maintenance and repair operations.

Referring to FIGS. 1 and 2A, the desk system 10 also includes monitor cowlings 212, 214 which function to provide a ventilated cover for the computer monitors 97, 122, respectively. The cowling 212 is attached in cantilevered fashion to the slat wall partition 60. Telescoping struts 216 (only one being visible in FIG. 2A) are pivotally attached to the slat wall partition 60 and to the cowling 212 so that the cowling 212 can be pivoted between a closed position (as shown in FIG. 2A) and an open position (as shown in FIG. 3). When the cowling 212 is in its open position, the computer monitor 97 is substantially uncovered and thereby readily accessible to a user, a repairman or a technician. When the cowling 212 is in its closed position, its curved upper surface inhibits the placement of foreign objects that would obstruct a user's line of sight.

Similarly, the cowling 214 is attached in cantilevered fashion to the slat wall partition 60. Telescoping struts 218 (only one being visible in FIG. 2A) are pivotally attached to the slat wall partition 60 and to the cowling 214 so that the cowling 214 can be pivoted, like the cowling 212, between a closed position (as shown in FIGS. 2A and 3) and an open position (not shown in FIGS. 2A and 3). When the cowling 214 is in its open position, the computer monitor 122 is substantially uncovered and thereby readily accessible to a user, a repairman or a technician. When the cowling 214 is in its closed position, its curved upper surface inhibits the placement of foreign objects that would obstruct a user's line of sight.

Installation and Operation

It should be appreciated that the componential construction of the desk system 10 facilitates efficient field installation, as well as quick and easy adjustability and retrofittability. For instance, the size of the raceway core 12 can be readily modified to suit the following variables by replacing the upper struts 38, 44 and the lower struts 36, 42 with those having a different size (i.e., length): the changing work environment in the trading room which houses the desk system 10; the particular ergonomic preferences of the user; and changes in equipment size, shape and configuration. In addition, because the platforms 94, 110 are vertically and horizontally adjustable, their positions can be selectively varied to suit the above variables. Moreover, because the platforms 94, 110 are readily removable, they can be replaced by other platforms or components. The desk system 10 also provides flexibility in that it can be combined with other similar desk systems to form a variety of different cluster configurations. Furthermore, because the raceway 12 is common to two work stations, each being defined by one of the work tops 140, 142, the number of parts required to form a cluster of work stations can be decreased.

The desk system 10 also facilitates servicing and maintenance. For instance, the raceway fasciae 14, 16 are removably attached to the lower struts 36, 42 and to the upper struts 38, 44 by readily accessible and removable fasteners (not shown), such as bolts and the like. Thus, as shown in FIG. 3, after lifting the trolley 174 out of the raceway core 12 through its open top, the raceway fascia 14 can be detached from the remainder of the raceway core 12 and removed together with its corresponding work top subassembly (i.e., the one including the work top 140 and the support panels 128). Due to their physical attachment to the work top assemblies, the stands 120 would also have to be removed prior to the detachment and removal of their associated work top assembly.

Because the remainder of the raceway core 12 remains upright and stable, a repairman or a technician may gain easy and quick access to the raceway 18, as well as to the computer monitor 97 and to any other equipment which may be mounted on the platforms 94 or on the platforms 110. Even though the storage bins 124, the platforms 94 and hence the computer monitors 97 are cantilevered from the slat wall partition 60, the stability of the raceway core 12 is preserved due to the fact that its center of gravity is always maintained at a point lying in or near a plane defined by the slat wall partition 60 and hence one which passes through or near the central longitudinal axis of the raceway core 12.

It is also possible to remove the work top subassemblies without removing the raceway fasciae 14, 16. While the electronic equipment, such as the computer monitor 97, remains fairly accessible, access to the raceway 18 would be somewhat hindered by the raceway fasciae 14, 16.

The Second Embodiment

Figure 4:
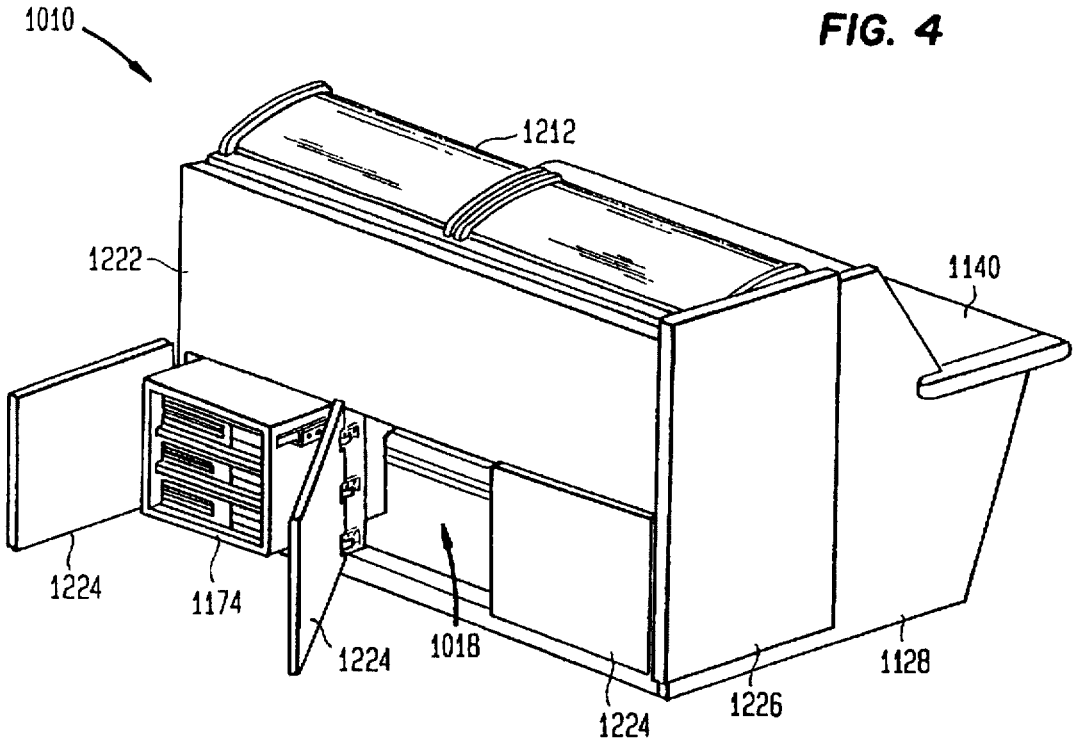
FIG. 4 is a rear perspective view of a flexible dealing desk system constructed in accordance with a second embodiment of the present invention.
Figure 5:
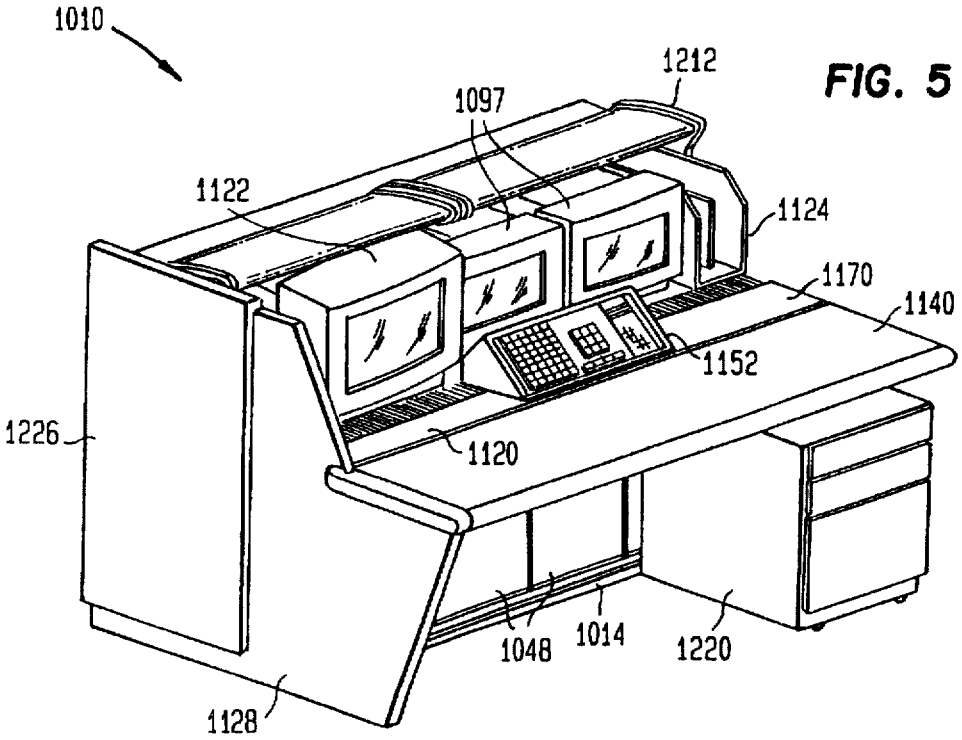
FIG. 5 is a front perspective view of the dealing desk system shown in FIG. 4.

FIGS. 4 and 5 depict a second embodiment of the present invention. Elements illustrated in FIGS. 4 and 5 which correspond, either identically or substantially, to the elements described above with respect to the embodiment of FIGS. 1–3 have been designated by corresponding reference numerals increased by one thousand. Unless otherwise stated, the embodiment of FIGS. 4 and 5 is constructed and assembled in the same basic manner as the embodiment of FIGS. 1–3.

Referring to FIGS. 4 and 5, a dealing desk system 1010 is shown which is a single work station counterpart of the embodiment shown in FIGS. 1–3. The construction and operation of the desk system 1010 of FIGS. 4 and 5 are basically the same as those of the embodiment of FIGS. 1–3, except as follows. One difference between the embodiment of FIGS. 1–3 and the embodiment of FIGS. 4 and 5 resides in the use, by the desk system 1010, of only one support panel 1128, the other support panel being replaced with a drawer pedestal 1220. Due to the elimination of one of the two work stations employed by the embodiment of FIGS. 1–3, another difference resides in the desk system 1010 being provided with a rear panel 1222 which is equipped with access doors 1224 adapted to provide access to an electronic equipment trolley 1174. Also, because the desk system 1010 is an end unit, it comes equipped with a full end panel 1226 which closes off one end of an otherwise substantially unobstructed raceway 1018 defined by the rear panel 1222 and a raceway fascia 1014.

Third Embodiment

Figure 6:
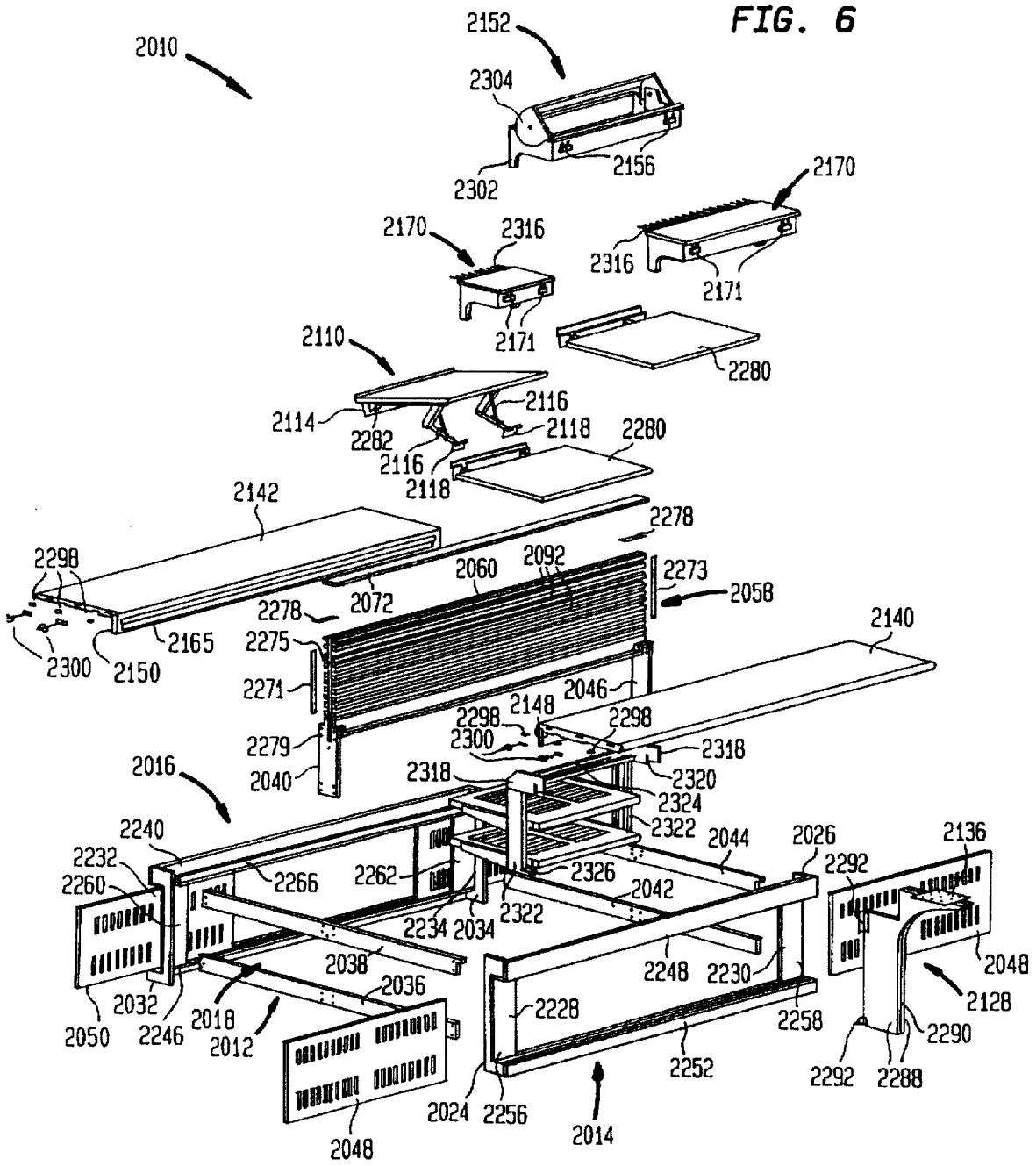
FIG. 6 is an exploded perspective view of a flexible dealing desk system constructed in accordance with a third embodiment of the present invention.
Figure 7:
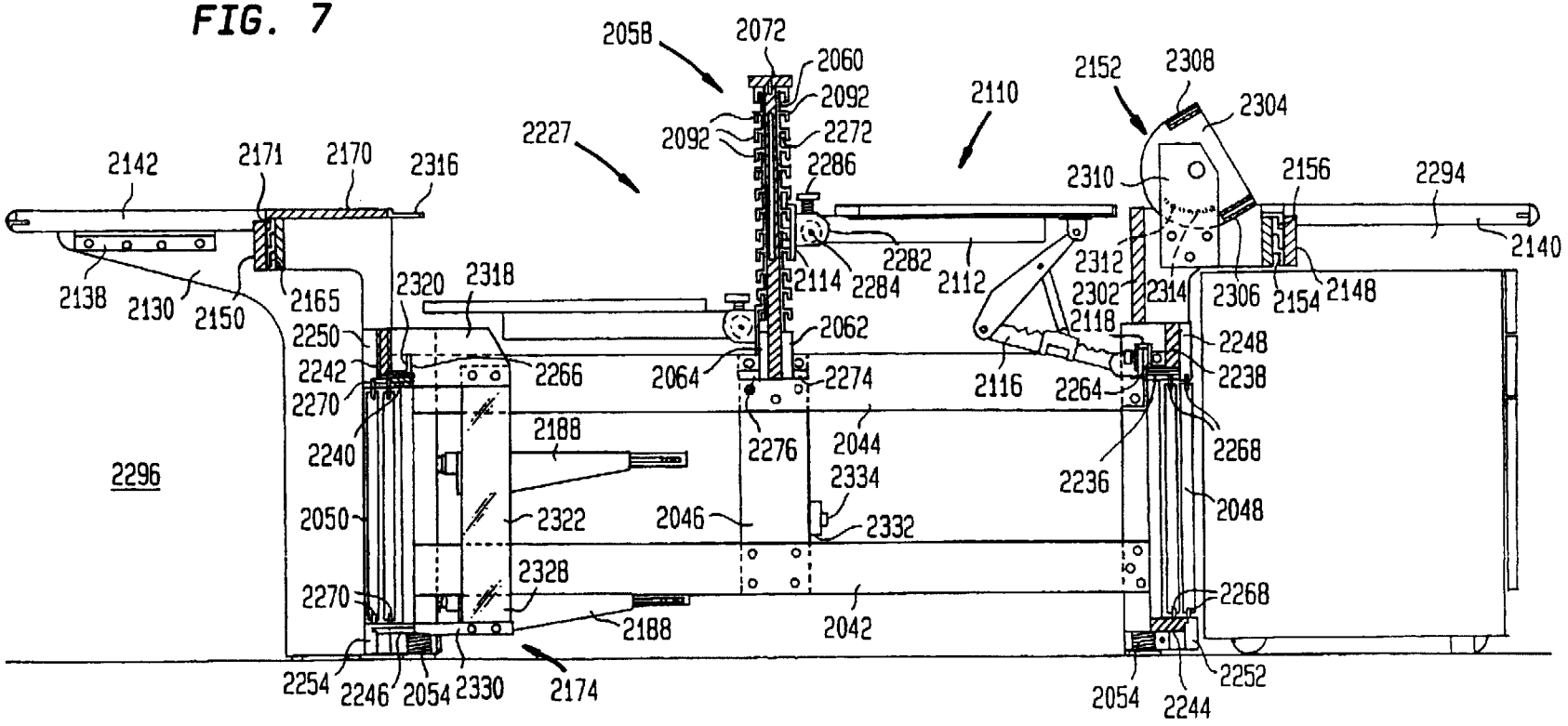
FIG. 7 is a transverse cross-sectional view of the dealing desk system shown in FIG. 6.

FIGS. 6 and 7 depict a third embodiment of the present invention having a double work station construction. Elements illustrated in FIGS. 6 and 7 which correspond, either identically or substantially, to the elements described above with respect to the embodiment of FIGS. 1–3 and/or the embodiment of FIGS. 4 and 5 have been designated by corresponding reference numerals increased by two thousands and by one thousand, respectively. Unless otherwise stated, the embodiment of FIGS. 6 and 7 is constructed and assembled in the same basic manner as the embodiment of FIGS. 1–3 and/or the embodiment of FIGS. 4 and 5.

The Raceway Core Subassembly

Referring to FIGS. 6 and 7, a dealing desk system 2010 includes a freestanding raceway core 2012 made from raceway fascia subassemblies 2014, 2016 which cooperate with each other so as to define a substantially unobstructed raceway 2018 extending laterally from one end of the raceway core 2012 to an opposite end of the raceway core 2012. In addition, the raceway core 2012 has a substantially open top such that the raceway is easily accessible from an equipment bay 2227 formed above the raceway core 2012 along the entire length thereof. The raceway 2018 is large enough to create a crawlspace and to otherwise accommodate telephone, data and electrical service lines and accessory equipment to be described in more detail hereinafter. Moreover, the size of the raceway 2018 and its unobstructed nature facilitate accessibility by technicians responsible for servicing the equipment housed in the raceway 2018. Because the raceway core 2012 is also designed for easy assembly and disassembly, initial installation and periodic servicing by technicians, as well as adjustability and retrofitting, are further facilitated as described in greater detail hereinafter.

The Raceway Fascia Subassemblies

With reference to FIGS. 6 and 7, the raceway fascia subassembly 2014 includes a pair of C-shaped outer posts 2024, 2026, which have slots 2228, 2230, respectively, formed therein and which are positioned at opposite ends of the raceway fascia subassembly 2014. Likewise, the raceway fascia subassembly 2016 includes a pair of C-shaped outer posts 2032, 2034, which have slots 2232, 2234, respectively, formed therein and which are positioned at opposite ends of the raceway fascia subassembly 2016. A header member 2236 and a header support member 2238, which is mounted on the header member 2236, are attached to upper ends of the C-shaped posts 2024, 2026 of the raceway fascia subassembly 2014, while a header member 2240 and a header support member 2242, which is mounted on the header member 2240, are attached to upper ends of the C-shaped posts 2032, 2034 of the raceway fascia subassembly 2016. Similarly, a sill member 2244 is attached to lower ends of the C-shaped posts 2024, 2026 of the raceway fascia subassembly 2014, while a sill member 2246 is attached to lower ends of the C-shaped posts 2032, 2034 of the raceway fascia subassembly 2016. Further, header facial panels 2248, 2250 are mounted on the header members 2236, 2240, respectively, while sill facial panels 2252, 2254 are mounted to the sill members 2244, 2246, respectively. Moreover, vertical panels 2256, 2258 are mounted in the slots 2228, 2230, respectively, of the C-shaped posts 2024, 2026, respectively, while vertical panels 2260, 2262 are mounted in the slots 2232, 2234, respectively, of the C-shaped posts 2032, 2034, respectively. The C-shaped posts 2024, 2026, the header member 2236, the header support member 2238, the sill member 2244 and the vertical panels 2256, 2258 cooperate with one another so as to define the raceway fascia subassembly 2014 as an integrated (i.e., self-contained) and stressed (i.e., self-supporting) module. Similarly, the C-shaped posts 2232, 2234, the header member 2240, the header support member 2242, the sill member 2246 and the vertical panels 2260, 2262 cooperate with one another so as to define the raceway fascia subassembly 2016 as an integrated (i.e., self-contained) and stressed (i.e., self-supporting) module. In other words, the raceway fascia subassemblies 2014, 2016 form self-supporting, load bearing members of the desk system 2010, thereby eliminating the need for load bearing frames associated with the frame-type desk systems described above.

The raceway fascia subassemblies 2014, 2016 are also provided with L-shaped brackets 2264, 2266, respectively, mounted on the header members 2236, 2240, respectively, along the entire length of same adjacent the raceway 2018 for purposes to be discussed hereinafter. In addition, the raceway fascia subassemblies 2014, 2016 include sliding door tracks 2268, 2270, respectively, and sliding doors 2048, 2050, respectively, which are adapted to move along the door tracks 2268, 2270, respectively, to ventilate the raceway 2018 and to provide access to same. A plurality of levelers 2054 are also provided so as to permit leveling of the desk system 2010 in a conventional manner.

The raceway fascia subassemblies 2014, 2016 are removably connected to each other via upper struts 2038, 2044, and lower struts 2036, 2042. More particularly, the lower strut 2036 and the upper strut 2038 are removably attached to the C-shaped posts 2024, 2032 of the raceway fascia subassemblies 2014, 2016, respectively, while the lower strut 2042 and the upper strut 2044 are removably attached to the C-shaped posts 2026, 2034 of the raceway fascia subassemblies 2014, 2016, respectively. In this manner, the raceway fascia subassemblies 2014, 2016 cooperate to form the raceway core 2012. The lower struts 2036, 2042 are suspension-mounted (i.e., mounted above the floor supporting the desk system 2010) for purposes to be discussed hereinafter.

The Slat Wall Partition Subassembly

With reference to FIGS. 6 and 7, the desk system 2010 is also provided with a slat wall partition subassembly 2058 constructed as an integrated and self-supporting module. More particularly, the slat wall partition subassembly 2058 includes a slat wall partition 2060, which is provided with a plurality of downwardly projecting L-shaped slats 2092 on both sides thereof. In addition, longitudinal support members 2062, 2064 are attached to the sides of the slat wall partition 2060 adjacent a lower end thereof for purposes to be discussed hereinafter, while ledges 2274, 2276 are formed from lower ends of the longitudinal support panels 2062, 2064, respectively. The slat wall partition subassembly 2058 is also provided with a wafer 2272 mounted therewithin, a pair of connecting splines 2271, 2273, portions of which are positioned into slots 2275 formed between the sides of the slat wall partition 2060, and a pair of connecting plates 2278 at an upper end of the slat wall partition 2060. The connecting splines 2271, 2273, the wafer 2272 and the connecting plates 2278 cooperate with each other so as to adjoin, align and reinforce a pair of adjacent slat wall partitions 2060 when a plurality of the desk systems 2010 is utilized to form a cluster of side-by-side workstations. The slat wall partition subassembly 2058 also includes an upper cap 2072, which extends along the upper end of the slat wall partition 2060, and a pair of vertical support posts 2040, 2046 which are removably attached to the slat wall partition 2060 for mounting the slat wall partition 2060 on the raceway core 2012. More particularly, the vertical support posts 2040, 2046 are provided with notches 2279 (only one of which is shown in FIG. 6) centrally positioned at upper ends of the vertical support posts 2046. The notches 2279 are sized and shaped so as to receive the lower end of the slat wall partition 2060 in flush fashion in which outer sides of the vertical support posts 2040, 2046 are flush with the opposing ends of the slat wall partition 2060. In this manner, when a cluster of side-by-side work stations are formed by utilizing a plurality of the desk systems 2010, the slat wall partition 2060 of a workstation can be connected to its adjacent slat wall partitions in adjoining relationship. Further, the vertical support post 2040 is removably attached to the upper and lower struts 2036, 2038, while the vertical support post 2046 is removably attached to the upper and lower struts 2042, 2044. Unlike the vertical support posts 40, 46 of the desk system 10 illustrated in FIGS. 1-3, the vertical support posts 2040, 2046 are suspension-mounted (i.e., mounted above the floor supporting the desk system 2010).

The desk system 2010 also includes a plurality of tiltable platforms 2110, 2280 adapted to be cantilevered from the slat wall partition 2060. More particularly, the tiltable platform 2110 is equipped with a pair of horizontal support members 2112 (only one of which is shown in FIG. 7) having a unitary Z-shaped flange 2114 which extends substantially along the entire length of the platform 2110. The Z-shaped flange 2114 can be interconnected with and disconnected from the slats 2092 of the slat wall partition 2060 such that the height of the platform 2110 can be adjusted (i.e., raised or lowered) by the installer or by the user and such that the platforms 2110 can be positioned at any point along the length of the slats 2092. Because of its unitary construction, the Z-shaped flange 2114 is able to withstand greater load than its counterpart of the desk system 10 illustrated in FIGS. 1–3. The Z-shaped flange 2114 is pivotally connected to the support members 2112 via a pair of pivot sockets 2282 so that the angular orientation of the platform 2110 relative to the horizontal can be adjusted to accommodate the ergonomic preferences of the user. The platform 2110 also includes a pair of scissors ratchets 2116 having upper ends, which are attached to the platform 2110, and lower ends, which have clips 2118 adapted to be clipped onto a corresponding one of the L-shaped brackets 2264, 2266 of the raceway fascia subassemblies 2014, 2016, respectively. The scissors ratchets 2116 articulate (i.e., expand and retract) as the angular orientation of the platform 2110 is adjusted. In addition, the platform 2110 is provided with a pair of friction grommets 2284 (only one of which is shown in FIG. 7) mounted within the sockets 2282, as well as a pair of securing knobs 2286 (only one of which is shown in FIG. 7) mounted on upper sides of the sockets 2282 for tightening and loosening the frictional engagement between the grommets 2284 and their corresponding support members 2112. The securing knobs 2286, the friction grommets 2284 and the scissors ratchets 2116 cooperate to maintain the platform 2110 in its adjusted angular orientation. More particularly, once the platform 2110 is adjusted, the platform 2110 is designed to withstand the weight of any monitors (not shown), as well as that of any technicians who customarily walk on top of the desk system 2010 during its installation.

The platforms 2280 are constructed in the same manner in which the platform 2110 is constructed, except that the platforms 2280 are not provided with the scissors ratchets 2116. Accordingly, the platforms 2280 are generally used to support relatively light load as compared to the load typically supported on the platform 2110. Due to the provision of the longitudinal support members 2062, 2064, the platforms 2280, as well as the platform 2110, can be cantilevered from the lowest slat 2092 of the slat wall partition 2060 (see FIG. 7). More particularly, the longitudinal support members 2062, 2064 function to provide additional support area for Z-shaped flanges of the platforms 2280 and to orient the platforms 2280 in their horizontal position.

The Work Top Subassembly

With reference to FIGS. 6 and 7, the desk system 2010 is also provided with a pair of support panels 2128 (only one of which is shown in FIG. 6), each of which is constructed as an integrated self-supporting module. More particularly, each support panel 2128 includes a pair of outer panels 2288 and an intermediate panel 2290 positioned between the outer panels 2288. Further, the support panels 2128 are removably attached to the header member 2236 and the sill member 2244 of the raceway subassembly 2014 via L-shaped connecting plates 2292. The support panels 2128 extend outwardly from or alongside the lateral ends the raceway subassembly 2014 and form a knee well 2294 therebetween. In addition, the support panels 2128 are sized and shaped so as to make the knee well 2294 ergonomic by maximizing the knee clearance within the knee well 2294.

The desk system 2010 is also provided with another pair of support panels 2130 (only one of which is shown in FIG. 7), each of which is removably attached to the header member 2240 and the sill member 2246 at the lateral ends of the raceway fascia subassembly 2016 so as to form a knee well 2296 therebetween. The construction and operation of the support panels 2130 are basically the same as those of the support panels 2128.

Work tops 2140, 2142 rest on the support panels 2128, 2130, respectively, to form a pair of back-to-back work stations. More particularly, the work tops 2140, 2142 are secured to the support panels 2128, 2130, respectively, by connecting plates 2136, 2138, respectively. In addition, the work tops 2140, 2142 include support stringer cleats 2148, 2150, respectively, depending therefrom, and upwardly projecting Z-clips 2154, 2165, respectively, mounted to the cleats 2148, 2150, respectively, and extending therealong. The work tops 2140, 2142 are also provided with alignment wafers 2298, which function to align the work tops 2140, 2142 with their adjacent work tops (not shown) when the desk system 2010 is utilized for forming a side-by-side cluster of workstations, and fastening mechanisms 2300 for securing the work tops 2140, 2142 to their adjacent work tops. The work tops 2140, 2142 are spaced apart from the raceway fascia subassemblies 2014, 2016, respectively, such that the equipment bay 2227 extends over the knee wells 2294, 2296. The equipment bay 2227 is sized and shaped so as to receive various combinations of equipment bay furnishings, including an adjustable telecommunication turret 2152 and semi work top extensions 2170. Moreover, the work tops 2140, 2142 are constructed as integrated and self-supporting modules. In other words, the work tops are 2140, 2142 are sufficiently thick to support their own weight, as well as loads placed thereupon, without the need for the provision of a frame associated with the frame-type desk systems discussed above.

The adjustable telecommunication turret 2152, which is constructed as an integrated module, is inserted into the equipment bay 2227. More particularly, the telecommunication turret 2152 includes a pair of mating downwardly-projecting Z-shaped clips 2152, each being sized and shaped so as to be clipped onto the Z-shaped clip 2154 of the work top 2140 for mounting the telecommunication turret 2152 onto the work top 2140. Further, the telecommunication turret 2152 includes an extension 2302 which rests on the raceway fascia subassembly 2014. The telecommunication turret 2152 also includes a pivotable crib 2304 provided with a lower stop 2306 and an upper stop 2308 for defining the range of rotation of the crib 2304 and for thereby inhibiting the crib 2304 from overturning. The telecommunication turret 2152 also includes hinge plates 2310 provided with a locking mechanism. More particularly, each of the hinge plates 2310, to which the crib 2304 is pivotally mounted at opposite ends of the crib 2304, includes dimples 2312 formed thereon for engaging with mating bullets 2314 formed on the crib 2304. The dimples 2312 and the bullets 2314 allow the angular orientation of the crib 2304 to be adjusted by predetermined angular increments. In this manner, the operating life of the telecommunication 2152 is prolonged as compared to conventional telecommunication turret utilizing friction-type locking mechanisms.

The semi work top extensions 2170 are removably mounted in the equipment bay 2227 in the same basic manner as the telecommunication turret 2152 is mounted in the equipment bay 2227 for increasing the size of the overall work top area. More particularly, each semi work top extension 2170 includes a pair of mating downwardly-projecting Z-shaped clips 2171 sized and shaped to be clipped onto the Z-shaped clip 2165 of the work top 2142. In addition, each semi work top extension 2170 is provided with a continuous brush grommet extension 2316 for allowing unobstructed cable management. In other words, electrical cords of various devices placed on the work top (e.g., a lap top computer) can be run through the brush grommet extension 2316 and into the raceway 2018 and/or the knee well 2296, thereby gaining access to electrical outlets mounted therein.

The Rack Subassembly

Referring to FIG. 7, due to the size of the raceway 2018 and its lack of significant obstructions, it is adapted to accommodate power and data line termination, such as demarcation panels and patch panel boxes. The raceway 2018 is also sized and shaped to house local area network and market data central processing units and file servers. More particularly, a rack subassembly 2174 is mounted within the raceway 2018. The rack subassembly 2174 includes support plates 2318 having slots 2320 sized and shaped to engage with the L-shaped bracket 2266 such that the rack subassembly 2174 is suspended from the L-shaped bracket 2266 and is laterally movable along the raceway 2018. The rack subassembly 2174 also includes U channels 2322 depending from the support plates 2318. In addition, upper beams 2324 extend between the support plates 2318, while lower beams 2326 extend between lower ends 2328 of the U channels 2322. Tabs 2330 are attached to the lower ends 2328 of the U channels 2322 and function to bear against the sill member 2254 of the raceway fascia subassembly 2016 for orienting the rack subassembly 2174 in its plumb position. The rack subassembly 2174 also includes a plurality of trays 2188 sized and shaped so as to carry electronic equipment (not shown), such as a central processing unit. The trays 2188 are slidably mounted on the U channels 2322 such that each of the trays 2188 can be moved between a retracted position, in which it is housed completely within the raceway core 2012, and an extended position, in which it projects outwardly from the raceway core 2012. In this manner, when the access doors 2050 of the raceway fascia subassembly 2016 are opened, the trays 2188 can be extended far enough so as to project outwardly from the raceway core 2012, thereby providing easy access to the electronic equipment carried by the trays 2188. In addition to the trays, the rack subassembly 2174 is equipped with a plurality of patch panels (not shown) and strain relief and cable management components (not shown).

The desk system is also provided with a demarcation panel 2332 removably mounted in the raceway core 2012 below the slat wall partition 2060. A strip of electrical outlets 2334 is removably attached to the demarcation panel 2332 for providing electricity to electrical and/or electronic devices mounted on the desk system 2010. In this manner, the strip of electrical outlets 2334 can be dismounted from the desk system 2010 without disrupting continuous provision of electricity to the electrical devices.

Installation and Operation

Each module of the desk system 2010 (e.g., the raceway fascia subassemblies 2014, 2016 and the slat wall partition subassembly 2058) is preformed before shipping to an installation site, such as a trading room. At the installation site, the upper struts 2038, 2044 and the lower struts 2036, 2042 are removably attached to the raceway fascia subassemblies 2014, 2016 in the manner described above, thereby forming the raceway core 2012. Then, the slat wall partition subassembly 2058 is mounted on the raceway core 2012, and the rack subassemblies 2174 are mounted in the raceway 2018. The support panels 2128, 2130 are also attached to the raceway fascia subassemblies 2014, 2016, and the work tops 2140, 2142 are mounted onto the support panels 2128, 2130, respectively. Next, the equipment bay furnishings, such as the telecommunication turret 2152 and the semi work top extensions 2170, are mounted onto the desk system 2010 as described above. In addition, the platforms 2110, 2280 are removably cantilevered from the slat wall partition 2060 at desired elevations.

It should be appreciated that the desk system 2010 provides numerous advantages over the frame-type desk systems described above. First, because the desk system 2010 is formed by a combination of self-supporting (i.e., stressed) modules (e.g., the raceway fascia subassemblies 2014, 2016, the slat wall partition subassembly 2058, the support panels 2128, 2130 and the work tops 2140, 2142), each of which functions as a load bearing member, the desk system 2010 does not require a frame for supporting its own weight, as well as any additional loads (e.g., computer monitors) supported thereon. For instance, the raceway fascia subassemblies 2014, 2016 function as intermediate longitudinal support members; and, therefore, they eliminate the need to provide frames for raceway fasciae. More particularly, the raceway fascia subassemblies 2014, 2016 provide front load support for the platforms 2110, 2280 and rear load support for the telecommunication turrets 2152. The raceway fascia subassemblies 2014 and 2016 also facilitate in providing increased balance and therefore increased stability in desk system 2010 by allowing the floor support (i.e., the levelers 2054) to be positioned immediately behind the sliding doors 2048, 2050 and thereby moving the floor support substantially outwardly. By contrast, the frame-type desk systems have floor support substantially behind their access doors, and, as a result, they are less stable than the desk system 2010. Moreover, because the work tops 2140, 2142 are constructed as self-supporting modules, flexing and bowing associated with the work top of the frame-type desk system are minimized without the use of an angular tube frame. As a result, the knee wells 2294, 2296 under the work tops 2140, 2142, respectively, are maximized due to the elimination of any angular tube frame.

Second, because each module of the desk system 2010 can be preformed before shipping to an installation site, the desk system 2010 is adapted for efficient and cost-effective freight, as compared to the frame-type desk systems. More particularly, because the pre-assembled frame assemblies of the frame-type desk systems are bulky and large, freight costs associated with same are greater than those associated with the desk system 2010. On the other hand, if the frame assemblies of the frame-type desk systems are shipped to an installation site in their disassembled form, it would require substantial amount of time in assembling the frame assemblies.

Because each module of the desk system is integrated (i.e., self-contained), the assembly and the disassembly of the desk system 2010 is rendered more efficient than the frame-type desk systems described above. For instance, because the raceway fascia subassemblies 2014, 2016 and the slat wall partition subassembly 2258 are integrated modules, they are shipped to the installation site as readily usable units. As a result, the assembly of the raceway fascia subassemblies 2014, 2016 or the slat wall partition subassembly 2058 is not required, thereby reducing the installation time.

Owing to its modular construction, the desk system 2010 is also adapted for quick and easy adjustability and retrofittability. More particularly, because each module of the desk system 2010 is removably mounted to another module, it is easily replaceable. As a result, the desk system 2010 is easily adaptable to the following variables: the changing work environment in the trading room which houses the desk system 2010; the particular ergonomic preferences of the user; and changes in equipment size, shape and configuration. For instance, the size of the raceway core 2012 (i.e., the distance between the raceway fascia subassemblies 2014, 2016) can be easily changed by replacing the lower struts 2036, 2042 and the upper struts 2038, 2044 with similar struts of a different size (i.e., length). In addition, because the equipment bay furnishings (i.e., the telephone turret 2152, the semi work top extensions 2170 and the monitor platforms 2110) are independent from each other, any changes to the configuration of one of the furnishings (e.g., the tiltable telephone turret 2152) do not require adjustment to other equipment bay furnishings (e.g., the monitor platforms 2110). In addition, because the support panels 2128, 2130 are easily attachable and removable from the raceway fascia subassemblies 2014, 2016, respectively, they facilitate the assembly and disassembly of the desk system 2010, as compared to its counterpart in the frame-type desk system described above (i.e., the angular tube frame).

Efficiency concerning assembly and breakdown, as well as adjustability and retrofittability, of the desk system 2010 is further enhanced by the use of ergonomic mounting mechanisms adapted to quickly mount and dismount their associated components without the use of a tool. For instance, no tool is required to mount and/or dismount the monitor platform 2110 from its associated slat 2092. More particularly, to dismount the monitor platform 2110, the securing knobs 2286 are first loosened. Next, with the scissors ratchets 2116 being supporting on a corresponding one of the L-shaped bracket 2264, 2266, the front end of the platform 2110 is lifted, thereby pivoting the platform 2110 about the point of the engagement between the Z-shaped flange 2114 and its associated L-shaped slat 2092. As the platform 2110 is pivoted, the Z-shaped flange 2114 disengages from its associated L-shaped slat, and the platform 2110 is thereby removed from same. In this maimer, the removal and/or adjustment of the platform 2110 are rendered easier and more efficient than those of the platforms of the frame-type desk systems which need to be lifted straight up in order to dismount the platform because of its associated upwardly projecting slat. In addition, because the prior art platforms are equipped with control knobs mounted on its underside, it is difficult to gain access to such control knobs.

It should also be appreciated that because the desk system 2010 eliminates the use of floor-located cross supports which are utilized by the frame-type desks discussed above, the desk system 2010 minimizes its interference with and/or obstruction to floor-mounted outlets and cable access ports. In other words, because the support structures (e.g., the upper and lower struts 2038, 2044, 2036, 2042) of the desk system 2010 are adapted for suspension-mounting (i.e., being mounted above the floor supporting the desk system 2010), the desk system 2010 is adapted to accommodate continuous floor-mounted wire ways extending along a cluster of work stations.

It should be noted that by using a plurality of the desk systems 2010, a cluster of side-by-side work stations can be formed. In such a side-by-side construction, there are additional advantages associated with the desk system 2010 over the frame-type desk systems described above. For instance, because the desk system 2010 utilizes the C-shaped outer posts 2024, 2026, 2032, 2034 and because the support panels 2128, 2130 do not interfere with the operation of the access doors 2048, 2250, the access doors 2048, 2250 are slidable from one work station to an adjacent work station. In addition, a continuous equipment bay is formed extending from one end of the cluster to an opposite end of the cluster. Moreover, because the slat wall partition 2060 is mounted on the vertical support posts 2040, 2046 in flush fashion and because the wafer 2272 and the connecting plates 2278 and the connecting splines 2271, 2273 cooperate to connect the slat wall partition an to adjacent slat wall partition in adjoining fashion, a continuous slat wall partition, which extends along the entire length of the continuous equipment bay, is formed. As a result, the equipment bay furnishings, including the platforms 2110, 2280, the telecommunication turrets 2152 and the semi work top extensions 2170, can be positioned at any point along the continuous equipment bay and the continuous slat wall partition, including a point above a seam formed between a pair of adjacent work stations.

It should be understood that the desk system 2010 can have many modifications and variations. For instance, the desk system 2010 can be modified to a desk system having a single work station construction similar to the desk system 1010 of FIGS. 4 and 5. Further, when the slat wall partition 2060 needs to withstand greater load, it can be provided with a direct vertical floor loaded support. In other words, it can be supported directly on the floor rather than being suspension-mounted. In addition, the desk system 2010 can be combined with other similar desk systems to form a variety of different cluster configurations. Further, the various components of the desk system 2010 can be replaced with their corresponding counterparts in the desk system 10 illustrated in FIGS. 1–3.

The Fourth Embodiment

Figure 8:
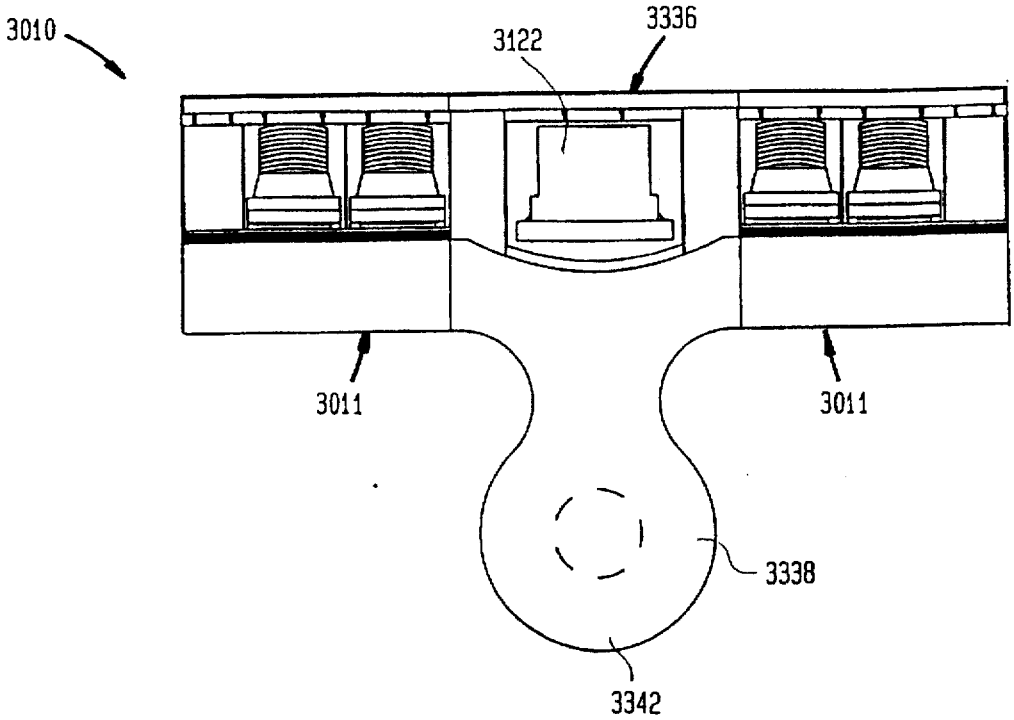
FIG. 8 is a top plan view of a flexible dealing desk system constructed in accordance with a fourth embodiment of the present invention.
Figure 9:
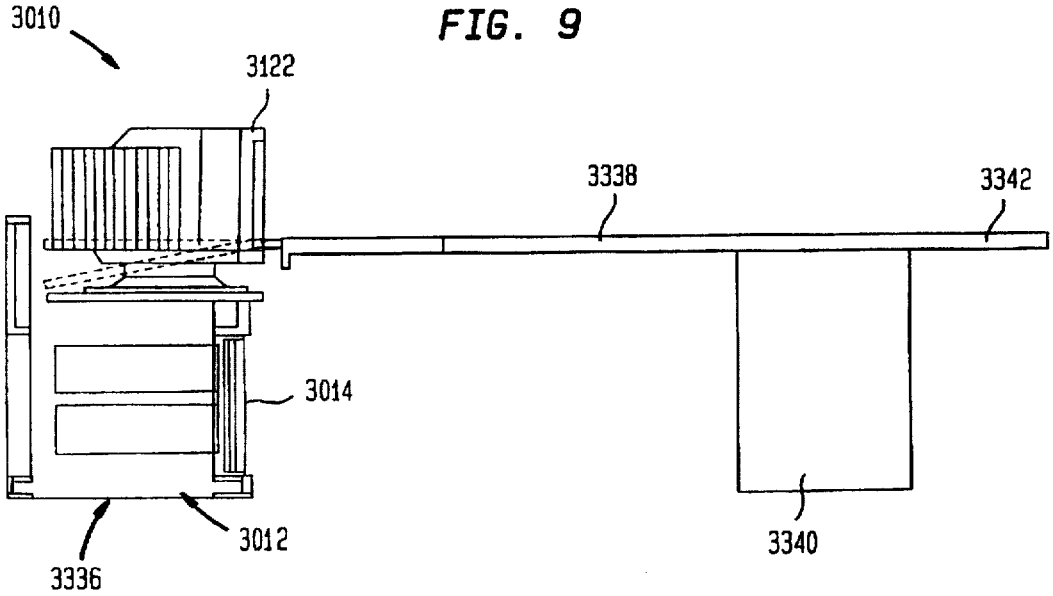
FIG. 9 is a transverse cross-sectional view of the dealing desk system shown in FIG. 8.

FIGS. 8 and 9 depict a fourth embodiment of the present invention having a conference work station construction. Elements illustrated in FIGS. 8 and 9 which correspond, either identically or substantially, to the elements described above with respect to the embodiment of FIGS. 1–3, the embodiment of FIGS. 4 and 5 and/or the embodiment of FIGS. 6 and 7 have been designated by corresponding reference numerals increased by three thousand, two thousand and one thousand, respectively. Unless otherwise stated, the embodiment of FIGS. 8 and 9 is constructed and assembled in the same basic manner as the embodiment of FIGS. 1–3, the embodiment of FIGS. 4 and 5 and/or the embodiment of FIGS. 6 and 7.

Referring to FIG. 8, a dealing desk system 3010 includes a conference station 3336 positioned between single work stations 3011. The construction and operation of the single work stations 3011 and the conference station 3336 of the desk system 3010 are basically same as those of the desk system 10 of FIGS. 1–3, the desk system of 1010 of FIGS. 4 and 5 and/or the desk system 2010 of FIGS. 6 and 7, except as follows.

The conference station 3336 is provided with a conference table 3338 extending outwardly from a raceway fascia subassembly 3014 of the conference station 3336 for accommodating a plurality of individuals. The conference table 3338 has a support leg 3340 adjacent one end 3342 thereof opposite the raceway fascia subassembly 3014. The conference station 3336 is provided with a large monitor 3122 such that the image appearing on the screen of the monitor 3122 can be viewed from the end 3342 of the conference table 3338.

It should be noted that the desk system 3010 can have many modifications. For instance, the conference table 3338 can be attached to a raceway core 3012 of the desk system 3010 in a similar manner in which the work tops 2140, 2142 of the desk system 2010 illustrated in FIGS. 6 and 7 are attached to the raceway core 2012. Moreover, the conference station 3336 can be positioned at an end of the desk system 3010 instead of between the single work stations 3011.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A stressed modular desk system, comprising a core having an interior raceway extending longitudinally from one end of said core to an opposite end of said core and a substantially open top, whereby said raceway is accessible through said open top of said core; mounting means, including a plurality of platforms, for mounting electronic equipment therefrom; supporting means, extending from said one end of said core to said opposite end of said core and spanning said raceway without significantly obstructing said open top of said core, for supporting said platforms such that each of said platforms extends outwardly from said supporting means above said raceway, at least one of said platforms being supported in a cantilevered fashion by said supporting means; a face panel removably attached to one side of said core; and a work top extending outwardly from said one side of said core, said work top being removably attached to said face panel, whereby said work top can be detached from said face panel and removed from said core or said panel can be detached from said core and removed therefrom together with said work top.

2. The desk system of claim 1, further comprising a telecommunication module for mounting telecommunication equipment in said desk system, said telecommunication module including a housing, a crib, which is pivotally mounted on said housing and which is sized and shaped so as to receive telecommunication equipment therein, and another mounting means for mounting said housing from a rear side of said work top in a cantilevered fashion, said another mounting means including a clip, which is attached to a front side of said housing and which is sized and shaped so as to engage a mating clip mounted along said rear side of said work top, and said housing having an extension sized and shaped so as to be supported on an upper end of said face panel when said housing is mounted from said work top.

3. The desk system of claim 1, wherein said at least one of said platforms includes a support panel for supporting electronic equipment thereon; a connector attached along a rear edge of said support panel, said connector being sized and shaped so as to engage mating one of slats provided on said supporting means, whereby said connector can be engaged with and disengaged from selected slats to thereby vary the position of said at least one of said platforms; pivoting means for allowing said connector to pivot relative to said support panel, whereby the angular orientation of said support panel is adjustable with respect to said supporting means when said connector is engaged with one of said slats; and an articulatable support leg having one end, which is attached to said support panel, and an opposite end, which is sized and shaped so as to be supported on an upper end of said face panel.

4. The desk system of claim 1, wherein said work top includes connecting means for connecting said work top to an adjacent work top of another desk system when said desk system is used in forming a cluster of side-by-side workstations.

5. The desk system of claim 1, further comprising housing means, positioned within said core and movable along said raceway between said one end of said core and said opposite end of said core, for housing electronic equipment.

6. The desk system of claim 5, wherein said housing means is movable between a retracted position, in which said housing means is located completely within said core, and an extended position, in which said housing means projects outwardly from said core, whereby electronic equipment carried by said housing means is more readily accessible when said housing means is in its said extended position.

7. The desk system of claim 6, further comprising holding means, positioned within said core and movable along said raceway between said one end of said core and said opposite end of said core, for holding fiber optic cables.

8. The desk system of claim 1, further comprising another face panel removably attached to an opposite side of said core; and another work top extending outwardly from said opposite side of said core, said another work top being removably attached to said another face panel, whereby said another work top can be detached from said another face panel and removed from said core or said another face panel can be detached from said core and removed therefrom together with said another work top.

9. The desk system of claim 8, further comprising first accessing means in said face panel for accessing said raceway from said one side of said core and second accessing means in said another face panel for accessing said raceway from said opposite side of said core.

10. The desk system of claim 9, wherein said supporting means extends along a central longitudinal axis of said core.

11. The desk system of claim 10, wherein said at least one of said platforms includes a first platform extending outwardly from said supporting means towards said one side of said core and second platform extending outwardly from said supporting means towards said opposite side of said core, whereby said first and second platforms extend outwardly from opposite sides of said supporting means.

12. The desk system of claim 11, further comprising first housing means, positioned within said core between said central longitudinal axis thereof and said face panel, for housing electronic equipment, said first housing means being movable along said raceway between said one end of said core and said opposite end of said core, and second housing means, positioned within said core between said central longitudinal axis thereof and said another face panel, for housing electronic equipment, said second housing, means being movable along said raceway between said one end of said core and said opposite end of said core.

13. The desk system of claim 12, wherein said first housing means is movable between a retracted position, in which said first housing means is located completely within said core, and an extended position, in which said housing means projects outwardly from said core through said first accessing means, whereby electronic equipment carried by said first housing means is more readily accessible when said first housing means is in its said extended position, and wherein said second housing means is movable between a retracted position, in which said second housing means is located completely within said core, and an extended position, in which said second housing means projects outwardly from said core through said second accessing means, whereby electronic equipment carried by said second housing means is more readily accessible when said second housing means is in its said extended position.

14. The desk system of claim 13, further comprising first holding means, positioned within said core between said central longitudinal axis thereof and said face panel, for holding fibre optic cables, said first holding means being movable along said raceway between said one end of said core and said opposite end of said core, and second holding means, positioned within said core between said central longitudinal axis thereof and said another face panel, for holding fiber optic cables, said second holding means being movable along said raceway between said one end of said core and said opposite end of said core.

15. The desk system of claim 8, wherein said work top defines a first work station and wherein said another work top defines a second work station, whereby said first and second work stations are arranged back-to-back.

16. The desk system of claim 15, wherein said core is freestanding and wherein said raceway is common to said first and second work stations and is large enough to constitute a crawlspace.

17. The desk system of claim 1, wherein said raceway is shaped and sized to constitute a crawlspace.

18. The desk system of claim 5, wherein said face panel includes a plurality of C-shaped posts, an upper strut, which extends between upper ends of said posts, a lower strut, which extends between lower ends of said posts, and another mounting means for mounting said housing means within said core from said upper strut.

19. The desk system of claim 18, wherein said mounting means includes a bracket extending along said upper strut.

20. The desk system of claim 1, further comprising a support panel for supporting said work top thereon, said support panel being removably attached to said work top and to said face panel, whereby said work top can be detached from said face panel by detaching said support panel from said face panel.

21. The desk system of claim 5, further comprising another mounting means for mounting said housing from an upper end of said face panel.

22. The desk system of claim 21, wherein said another mounting means includes a bracket extending along said upper end of said face panel.

23. The desk system of claim 22, wherein said housing includes a pair of beams suspended from said bracket.

24. The desk system of claim 23, wherein said housing means further includes a plurality of trays slidably mounted between said beams, each of said trays being movable between a retracted position, in which it is located completely within said core, and an extended position, in which it projects outwardly from said core through said face panel, whereby electronic equipment carried on said trays is more readily accessible when said trays are in their extended position.

25. The desk system of claim 21, wherein said at least one of said platforms includes a support leg having one end, which is attached to said at least one of said platforms, and an opposite end, which is mounted on said another mounting means.

26. The desk system of claim 1, further comprising housing means for housing telecommunication equipment between said supporting means and said work top.

27. The desk system of claim 26, further comprising another mounting means for mounting said housing means from one side of said work top in a cantilevered fashion.

28. The desk system of claim 27, wherein said housing means includes a crib which is pivotable relative to said housing means and which is sized and shaped so as to receive telecommunication equipment therein.

29. The desk system of claim 27, further comprising a work top extension mounted from said one side of said work top in a cantilevered fashion.

30. The desk system of claim 1, further comprising accessing means, mounted in said face panel, for accessing said raceway from said one side of said core.

31. The desk system of claim 30, wherein said face panel includes a pair of C-shaped posts, one of said posts being positioned at said one end of said core, and another of said posts being positioned at said opposite end of said core.

32. The desk system of claim 31, wherein said face panel includes a pair of struts interconnecting said posts.

33. The desk system of claim 32, wherein said accessing means includes a door slidably mounted on a track provided in said face panel.

34. The desk system of claim 33, wherein said face panel is sized and shaped so as to allow said door to move from said face panel to an adjacent face panel of another desk system when said desk system is used in forming a cluster of side-by-side workstations.

35. The desk system of claim 1, further comprising providing means for providing electricity to electrical devices accommodated in or on said desk system.

36. The desk system of claim 35, wherein said providing means includes a strip of electrical outlets, said strip of electrical outlets being removably mounted within said raceway.

37. The desk system of claim 1, wherein said supporting means includes connecting means for connecting said supporting means to adjacent supporting means of another desk system when said desk system is used in forming a cluster of side-by-side workstations.

38. A stressed modular desk, comprising a core having a pair of ends, a pair of sides, a bottom and a substantially open top; a raceway extending from one end of said core to the other end of said core, from one side of said core to the other side of said core and from said bottom of said core to said open top of said core, said raceway being accessible through said open top of said core and being shaped and sized so as to constitute a crawlspace; mounting means, including a plurality of platforms, for mounting electronic equipment therefrom; supporting means, extending from said one end of said core to said other end of said core and spanning said raceway without significantly obstructing said open top of said core and hence said raceway, for supporting said platforms such that each of said platforms extends outwardly from said supporting means above said raceway, at least one of said platforms being supported in a cantilevered fashion by said supporting means; a work top extending outwardly from said one side of said core so as not to obstruct said open top of said core and hence said raceway; and a cowling pivotally mounted from said supporting means, said cowling extending outwardly in a cantilevered fashion from said supporting means above said mounting means, whereby said cowling at least partially covers electronic equipment mounted on said mounting means.

39. The desk system of claim 1, wherein said supporting means is constructed as a module, said module including a slat wall partition, which has a generally planar construction and which includes a plurality of slats sized and shaped so as to removably receive a mating connector provided on said at least one of said platforms, whereby said connector can be engaged with and disengaged from selected slats to thereby vary the position of said at least one of said platforms, and a pair of support posts depending from opposite ends of said slat wall partition, one of said pair of posts being attached to said one end of said core and another of said pair of posts being attached to said other end of said core.

40. The desk system of claim 39, wherein said slats are downwardly projecting, whereby said connector can be disengaged from said slats by upwardly pivoting said at least one of said platforms.

41. The desk system of claim 38, wherein said supporting means includes a slat wall module having a slat wall partition, which includes a generally planar construction and a plurality of downwardly projecting slats sized and shaped so as to removably receive mating connectors provided on said platforms, whereby said connectors can be engaged with and disengaged from selected slats to thereby vary the position of said platforms and whereby said connectors can be disengaged from said slats by upwardly pivoting said platforms, and a pair of support posts depending from opposite ends of said slat wall partition, one of said support post being sized and shaped so as to be attached to said one end of said core, and another of said support post being sized and shaped so as to be attached to said other end of said core.

42. The desk system of claim 41, wherein some of said slats are arranged on one side of said slat wall partition and some of said slats are arranged on an opposite side of said slat wall partition.

43. The desk system of claim 41, further comprising connecting means for connecting said slat wall partition to an adjacent slat wall partition.

44. A stressed modular desk, comprising a core having a pair of ends a pair of sides, a bottom and a substantially open top; a raceway extending from one end of said core to the other end of said core, from one side of said core to the other side of said core and from said bottom of said core to said open top of said core, said raceway being accessible through said open top of said core and being shaped and sized so as to constitute a crawlspace; mounting means including a plurality of platforms, for mounting electronic equipment therefrom; supporting means, extending from said one end of said core to said other end of said core and spanning said raceway without significantly obstructing said open top of said core and hence said raceway, for supporting said platforms such that each of said platforms extends outwardly from said supporting means above said raceway, at least one of said platforms being supported in a cantilevered fashion by said supporting means; a work top extending outwardly from said one side of said core so as not to obstruct said open top of said core and hence said raceway; a face panel, which is removably attached to said one side of said core; a rack module mounted within said core and including a pair of beams and a plurality of trays, which are slidably mounted between said beams, each of said trays being movable between a retracted position, in which it is located completely within said core, and an extended position, in which it projects outwardly from said core, said trays being sized and shaped so as to support electronic equipment thereon; and another mounting means for mounting said beams from an upper end of said face panel.

45. The desk system of claim 38, wherein said core is freestanding.

* * * * *